US007093566B2

(12) United States Patent
Lach

(10) Patent No.: US 7,093,566 B2
(45) Date of Patent: Aug. 22, 2006

(54) VAPOR GENERATOR

(75) Inventor: Raymond Lach, Montreal (CA)

(73) Assignee: Maxitherm Inc., Montreal (CA)

( * ) Notice: Subject to any disclaimer, the term of this patent is extended or adjusted under 35 U.S.C. 154(b) by 137 days.

(21) Appl. No.: 10/986,099

(22) Filed: Nov. 12, 2004

(65) Prior Publication Data

US 2006/0102107 A1 May 18, 2006

(51) Int. Cl.
*F22G 3/00* (2006.01)

(52) U.S. Cl. ..... 122/459; 122/5.52

(58) Field of Classification Search ..... 122/410, 122/42, 466, 5.52, 36, 95.2, 174, 459; 126/350.2
See application file for complete search history.

(56) References Cited

U.S. PATENT DOCUMENTS

| | | | | |
|---|---|---|---|---|
| 1,703,093 | A * | 2/1929 | Brown | 122/1 R |
| 4,409,928 | A * | 10/1983 | Tursi et al. | 122/406.4 |
| 4,430,962 | A * | 2/1984 | Miszak | 122/406.4 |
| 4,895,136 | A | 1/1990 | Poppe | |
| 5,810,977 | A | 9/1998 | Annecharico et al. | |
| 5,918,570 | A * | 7/1999 | Gilchrist | 122/452 |
| 5,967,137 | A * | 10/1999 | Guillet et al. | 126/360.1 |
| 2003/0145806 | A1 | 8/2003 | Tokutake et al. | |

* cited by examiner

*Primary Examiner*—Gregory Wilson
(74) *Attorney, Agent, or Firm*—Francois Martineau

(57) ABSTRACT

A vapor generator comprising an evaporator unit, which in turn includes an inner chamber for containing a first fluid in a liquid state, and further includes a preheated liquid inlet and a vapor outlet, the evaporator unit having a heating device therein which can be activated for vaporizing the first fluid contained in the inner chamber to generate vapor. The vapor generator further comprises a preheating tank defining an inner chamber and comprising a liquid inlet for injection of the first fluid in a liquid state in the inner chamber, and a liquid outlet. Moreover, the vapor generator comprises an opened liquid channel connecting the preheating tank liquid outlet to the evaporator unit liquid inlet, and establishing free and continuous fluid communication between the preheating tank inner chamber and the evaporator unit inner chamber. The first fluid in a liquid state injected through the preheating tank liquid inlet is continuously distributed between the evaporator unit inner chamber and the preheating tank inner chamber through the liquid channel, and the heating device of the evaporator unit can be activated for generating a temperature gradient across the liquid-state first fluid contained in the evaporator unit inner chamber, the liquid channel and the preheating tank inner chamber, the first fluid being thereby gradually preheated while it circulates from the preheating tank through the liquid channel and into the evaporator unit for being vaporized therein.

19 Claims, 3 Drawing Sheets

VAPOR GENERATOR

FIELD OF THE INVENTION

The present invention relates to vapor generating systems, and more particularly to a system for generating dry vapor.

BACKGROUND OF THE INVENTION

Steam generating systems can be used in a wide variety of applications, e.g. for injecting moisture in the ventilation network of a building in order to increase the humidity levels in its rooms.

Heavy-duty steam generating systems generally comprise a heat exchanger unit comprising a tank containing water and having a steam outlet, the heat exchanger also comprising a heating device running through the tank, e.g. an electric heating element or thermally conductive tubes through which a stream of heating fluid circulates. The heating device can be activated to heat and eventually vaporize the water contained in the tank. The steam generated by such vaporization is then evacuated through the steam outlet of the tank, which is in turn linked to the ventilation network of the building.

A problem with common steam generating systems is the fact that the steam they produce is wet, in that in addition to gaseous water, this so-called wet steam comprises a substantial amount of minute liquid water droplets held in suspension in the gaseous water. This wet steam, when injected within the ventilation network of the building, causes undesirable water precipitation therein.

Moreover, existing steam generating systems are not very energetically efficient. This poor efficiency of existing steam generating systems is inter alia due to the fact that heating fluids are generally drained prematurely, while they still carry potential heating energy.

SUMMARY OF THE INVENTION

The present invention relates to a vapor generator, comprising:

an evaporator unit comprising an inner chamber for containing a first fluid in a liquid state, and further comprising a preheated liquid inlet, and a vapor outlet, said evaporator unit having a heating device therein which can be activated for vaporizing the first fluid contained in said inner chamber to generate vapor;

a preheating tank defining an inner chamber and comprising a liquid inlet for injection of the first fluid in a liquid state in said inner chamber, and a liquid outlet; and an opened liquid channel connecting said preheating tank liquid outlet to said evaporator unit liquid inlet, and establishing free and continuous fluid communication between said preheating tank inner chamber and said evaporator unit inner chamber;

wherein the first fluid in a liquid state injected through said preheating tank liquid inlet is continuously distributed between said evaporator unit inner chamber and said preheating tank inner chamber through said liquid channel, and wherein said heating device of said evaporator unit can be activated for generating a temperature gradient across the liquid-state first fluid contained in said evaporator unit inner chamber, said liquid channel and said preheating tank inner chamber, the first fluid being thereby gradually preheated while it circulates from said preheating tank through said liquid channel and into said evaporator unit for being vaporized therein.

In one embodiment, said liquid inlet and said liquid outlet of said preheating tank are significantly spaced apart from each other for allowing the liquid-state first fluid injected in said preheating tank to be preheated in said preheating tank before reaching said preheating tank liquid outlet.

In one embodiment, said preheating tank further defines a vapor inlet and a dry vapor exhaust port, said vapor generator further comprising:

a vapor channel linking said evaporator unit vapor outlet to said preheating tank vapor inlet;

a passageway extending between said evaporator unit vapor outlet and said preheating tank dry vapor exhaust port, said passageway defining a first portion extending within said vapor channel and a second portion wider than said first portion extending within said preheating tank;

wherein vapor generated from said first fluid in said evaporator unit and flowing out of said evaporator unit vapor outlet and along said passageway towards said dry vapor exhaust port will lose velocity when the vapor passes from said first passageway portion to said relatively wider second passageway portion to the extent of causing liquid-state first fluid droplets carried by the vapor to precipitate in said preheating tank for creating dry vapor to be exhausted through said dry vapor exhaust port.

In one embodiment, said preheating tank inner chamber defines a first cross-sectional area, and said vapor channel defines a second cross-sectional area smaller than said first cross-sectional area.

In one embodiment, said heating device comprises at least one thermally conductive tube extending in said evaporator unit inner chamber and for allowing a substantially hot heating fluid to flow therein for transferring heat to the first fluid in said inner chamber.

In one embodiment, a vapor chamber is defined in said evaporator unit inner chamber above the level of the liquid-state first fluid filling it, said evaporator unit comprising heat-emitting vapor drying means in said vapor chamber, and the wet vapor occupying said vapor chamber after it is generated in said evaporator unit is dried therein by said heat-emitting vapor drying means.

In one embodiment, said evaporator unit comprises evaporation rate control means for controlling the generation rate of vapor in said evaporator unit, thereby controlling the generation rate of dry vapor in said dry vapor generator.

In one embodiment, said heating device includes at least one thermally conductive tube extending in said evaporator unit inner chamber and for allowing a substantially hot heating fluid to flow therein for transferring heat to the liquid-state first fluid in said inner chamber, an upper portion of said at least one thermally conductive tube extending in said vapor chamber above the level of the liquid-state first fluid contained in said evaporator unit, said upper portion of said tube forming said vapor drying means.

In one embodiment, said at least one heat-transmitting tube defines upstream and downstream ends, and is connected at said upstream and downstream ends to a heating fluid circuit in which the heating fluid is destined to circulate.

In one embodiment, said evaporation rate control means comprise a control valve installed on said heating circuit upstream said at least one heat-transmitting tube.

In one embodiment, said evaporator unit includes a flooded heat exchanger, and said evaporation rate control means comprise a control valve installed on said heating circuit downstream said at least one heat-transmitting tube.

In one embodiment, said liquid inlet of said preheating tank is connected to a first fluid inlet line, which is provided with at least one preheating device for preheating the first fluid in a liquid state before it is injected in said preheating tank.

In one embodiment, said preheating device includes a liquid-state first fluid drainage port for allowing said evaporator unit and said preheating tank to be drained of liquid-state first fluid, said drainage port being linked to a liquid-state first fluid drainage line extending through a first heat exchanger through which said first fluid inlet line also extends for allowing drained first fluid to preheat the first fluid being fed to said preheating tank.

In one embodiment, said preheating device further comprises a second heat exchanger through which said first fluid inlet line extends for further preheating the liquid-state first fluid being fed into said preheating tank.

In one embodiment, the vapor generator further comprises a heating circuit through which a heating fluid circulates, said heating circuit being fluidly connected to at least one heat-transmitting tube extending through said evaporator unit inner chamber for allowing the heating fluid to flow therethrough for heating the liquid-state first fluid contained in said evaporator unit inner chamber, and wherein said second heat exchanger is connected to said heating circuit downstream of said heat-transmitting tube for allowing the heating fluid exiting said heat-transmitting tube of said evaporator unit to also preheat the first fluid being fed to said preheating tank.

The present invention also relates to a vapor generator for generating vapor by heating a second fluid with a first fluid, comprising:

a first fluid circuit comprising an upstream end, a downstream end and an intermediate portion therebetween, for allowing the first fluid to flow from said first fluid circuit upstream end to said first fluid circuit downstream end;

a second fluid circuit comprising an upstream end, a downstream end and an intermediate portion therebetween for allowing the second fluid to flow from said second fluid circuit upstream end to said second fluid circuit downstream end;

a heat exchanger unit wherein said intermediate portions of said first and second fluid circuits extend and are in adjacent, thermally-conductive contact for allowing heat transfer from the first fluid to the second fluid whereby liquid state second fluid can be evaporated into gazeous state, said heat exchanger unit comprising on said second fluid circuit a liquid-state second fluid inlet for allowing liquid-state second fluid to flow through said second fluid circuit intermdiate portion, and a gazeous-state second fluid outlet downstream of said liquid-state second fluid inlet for allowing gazeous-state second fluid to exit said heat exchanger unit;

a control valve on said first fluid circuit for controlling the flow rate of the first fluid in said first fluid circuit;

a preheating tank part of said second fluid circuit and upstream of said heat exchanger unit, said preheating tank comprising an inner chamber having a liquid-state second fluid inlet for injecting liquid-state second fluid in said preheating tank inner chamber, and a liquid-state second fluid outlet downstream of said liquid-state second fluid inlet for allowing liquid-state second fluid to exit said preheating tank inner chamber; and an opened liquid channel linking said preheating tank liquid-state second fluid outlet and said heat exchanger unit liquid-state second fluid inlet, and establishing free and continuous fluid communication between said heat exchanger unit and said preheating tank for allowing the liquid-state second fluid to be freely distributed between said preheating tank inner chamber and said heat exchanger unit;

wherein liquid-state second fluid injected through said preheating tank liquid-state second fluid inlet is gradually preheated as it flows through said preheating tank, said liquid channel and said heat exchanger unit second fluid circuit intermediate portion before being evaporated in said heat exchanger unit by means of the heat transfer from said first fluid circuit intermediate portion.

In one embodiment, said preheating tank further comprises a gazeous-state second fluid outlet and a gazeous-state second fluid inlet connected to said heat exchanger gazeous-state second fluid outlet with a vapor channel, said preheating tank inner chamber defining a vapor chamber portion between said gazeous-state second fluid inlet and said gazeous-state second fluid outlet, with said preheating tank vapor chamber portion being wider than said vapor channel for allowing gazeous-state second fluid flowing from said vapor channel into said preheating tank vapor chamber to lose velocity for allowing liquid-state second fluid droplets carried by the gazeous-state second fluid to precipitate in said preheating tank for creating dry vapor that will be exhausted through said preheating tank gazeous-state second fluid outlet.

In one embodiment, said heat exchanger unit is a flooded heat exchanger with said second fluid circuit intermediate portion comprising a heat exchanger inner chamber and said first fluid circuit intermediate portion comprising a number of heat-conducting tubes extending through said heat exchanger inner chamber for allowing said first fluid to flow through said tubes and the second fluid to be contained in said inner chamber, with said tubes being capable of being flooded with liquid-state first fluid in a determined proportion, said control valve being located downstream of said heat exchanger unit on said first fluid circuit whereby the proportion of said heat exchanger which is flooded within said second fluid circuit intermediate portion can be selectively calibrated.

In one embodiment, the vapor generator further comprises a liquid level controller for controlling the level of liquid-state second fluid in said preheating tank and in said heat exchanger unit inner chamber to maintain the level of liquid-state second fluid within top and bottom determined threshold values, whereby said preheating tank vapor chamber portion is defined above a variable liquid-state second fluid value which will not exceed said top threshold value, and whereby said heat exchanger unit inner chamber also defines a vapor chamber portion above a variable liquid-state second fluid value which will not exceed said top threshold value, with said tubes extending in said heat exchanger unit inner chamber at least partly above said top threshold value for allowing liquid-state second fluid carried by gazeous-state second fluid as it is evaporated in said heat exchanger unit inner chamber to be heated and evaporated through heat transfer from said tubes for creating dry vapor.

DETAILED DESCRIPTION OF THE EMBODIMENTS

Figure 1:
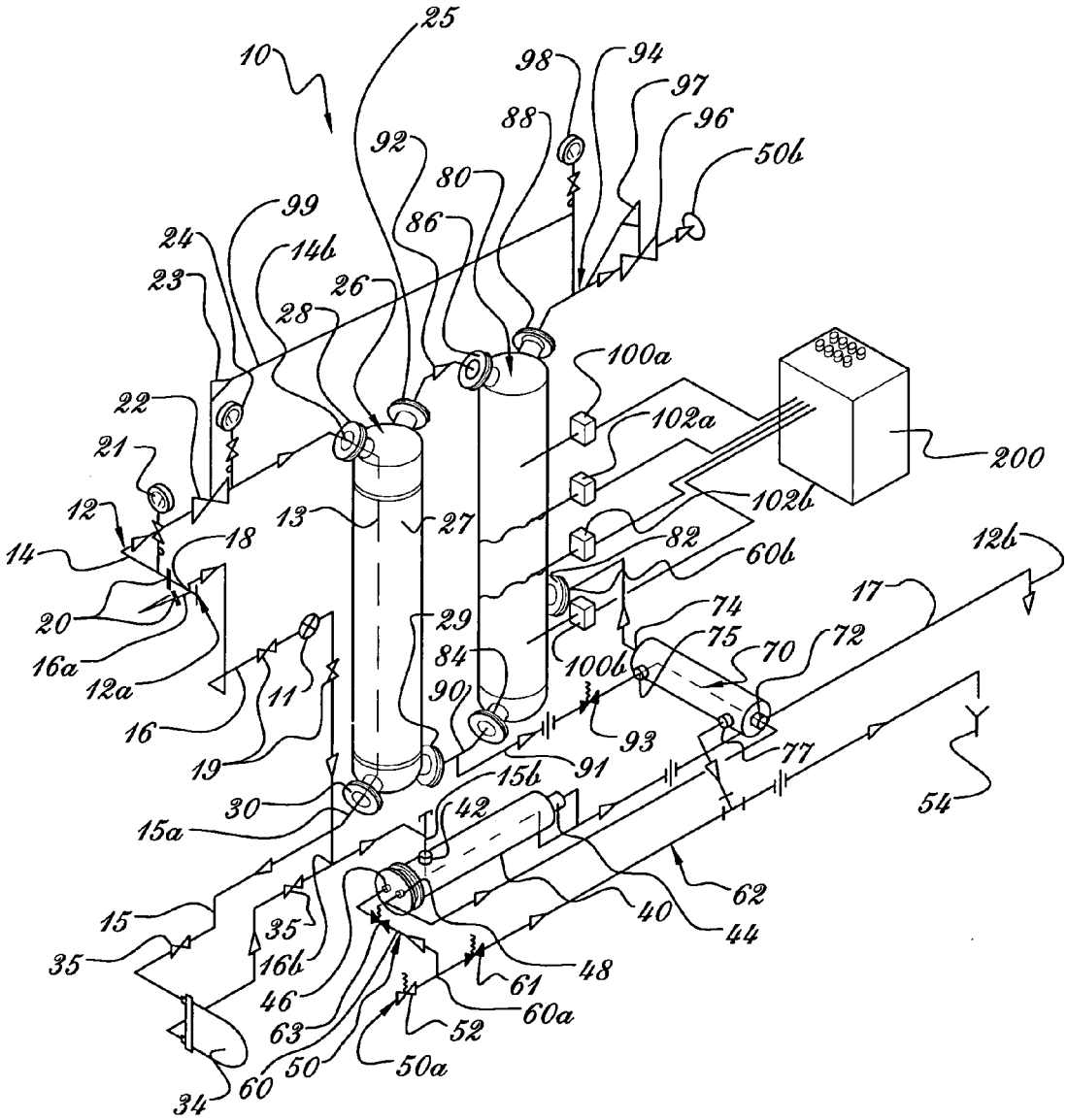
FIG. 1 shows a perspective schematic view of a dry steam generator according to one embodiment of the present invention.

FIG. 1 shows a dry steam generator 10 according to the present invention. Dry steam generator 10 comprises a number of fluid circuits as represented in FIG. 1, and the fluid flow direction in these fluid circuits is indicated by arrows. Although the invention will be described herein for generating dry steam from liquid-state water, it could be used alternately to generate dry vapor from liquids other than water.

Dry steam generator 10 comprises a first fluid circuit, called the heating circuit 12 herein, made of pipes or the like fluid-tight carrying medium, and which defines an upstream end 12*a* and a downstream end 12*b*. A heat-transmitting fluid, such as water, runs through heating circuit 12; the heat-transmitting fluid can have different pressures, temperatures and states depending on its progression along heating circuit 12. Although the heating-transmitting fluid could be any suitable fluid, the heat-transmitting fluid will be described as water hereinafter.

Upstream end 12*a* is an inlet allowing steam to be injected into heating circuit 12. Heating circuit 12 comprises, near upstream end 12*a*, an auxiliary liquid purge line 16 equipped with a sift, defining upstream and downstream ends 16*a* and 16*b*, and branching from the main steam line 14 at 18. Undesirable liquid-state water in steam line 14 will be recuperated in liquid purge line 16, which is equipped with a liquid purge valve 11 preventing steam from flowing therethrough. Selectively operable isolation valves 19, 19 are provided on either sides of liquid purge valve 11 for maintenance purposes.

A manometer 21 is installed at heating circuit upstream end 12*a* to measure the pressure of the fluid traveling across steam line 14. A steam inlet control valve 22 is installed on steam line 14 downstream of manometer 21, and is intended to regulate the flow rate of the steam flowing thereacross; control valve 22 is controlled by a controller 23. Downstream of control valve 22, a manometer 24 is installed, and steam line 14 is connected to a heat-exchange unit in the form of an evaporator 26, which is also schematically shown in FIG. 2.

Figure 2:
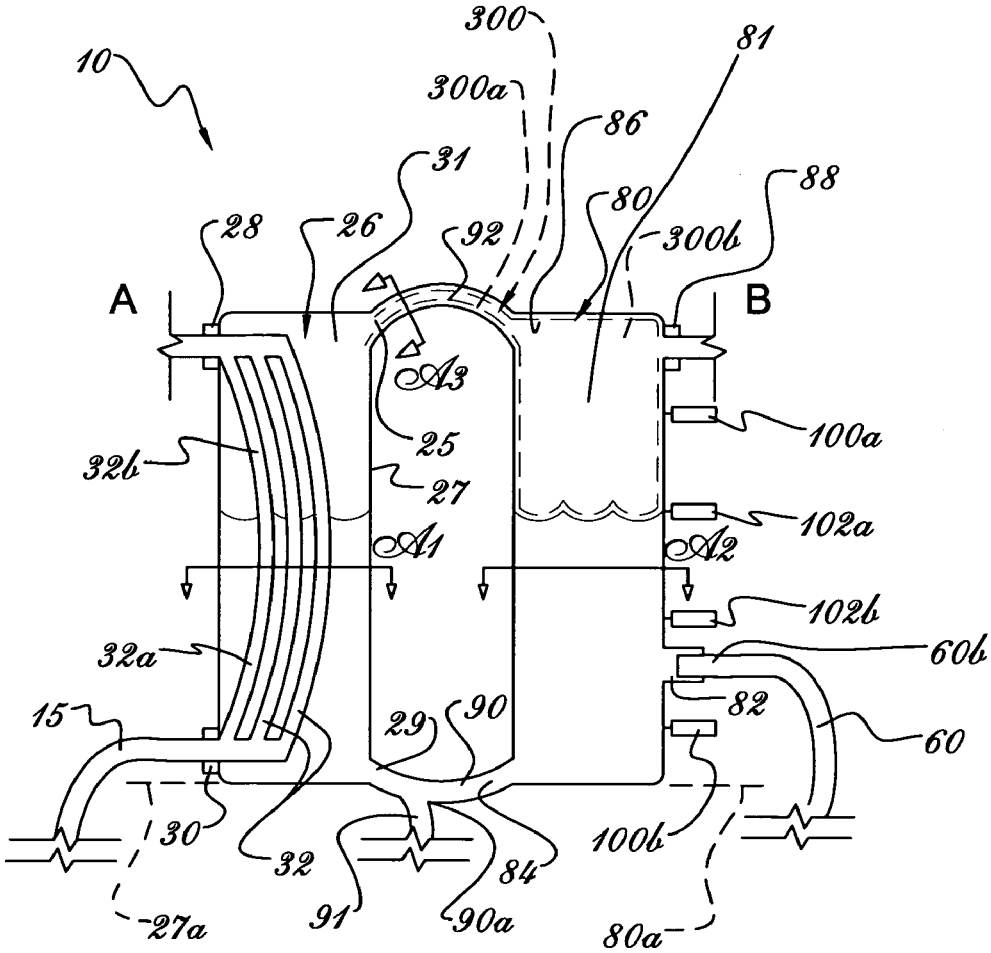
FIG. 2 is a schematic front cross-sectional view showing an evaporator and a preheating tank of the dry steam generator of FIG. 1.

Evaporator 26 comprises an evaporator tank 27 having an inner chamber defining a cross-sectional area $A_1$ (FIG. 2). Evaporator 26 further comprises a heating fluid inlet 28 connected to steam line 14, and a heating fluid outlet 30 connected to a first preheating fluid line 15 of heating circuit 12. A number of hollow thermally conductive tubes 32 fluidly connect heating fluid inlet 28 to heating fluid outlet 30, and run within the inner chamber of evaporator tank 27. The heating fluid can travel within thermally conductive tubes 32 to heat and eventually vaporize the water contained in evaporator tank 27. Although tubes 32 are shown to have but a slightly curved configuration in FIG. 2, it is understood that tubes 32 could (and usually will) have a sinuous, significantly curved, or corrugated configuration by which an increased heat exchange surface is provided for each tube 32. Baffle plates (not shown) can also be provided in evaporator tank 27. It is understood that other suitable inner evaporator configurations could be provided other than the schematic configuration shown in FIG. 2.

Evaporator tank 27 is destined to be filled with water injected therein through a water inlet 29 provided thereon at the vicinity of its bottom end. A steam chamber 31 is defined in the inner chamber of evaporator tank 27, above the volume of water filling the latter; of course, the volume of evaporator steam chamber portion 31 is inversely proportional to the variable percentage of evaporator tank 27 filled with liquid state water. It is noted that the level of liquid water within evaporator tank 27 is such that lower portions 32*a* of conductive tubes 32 are submerged in the liquid state water, and such that remaining upper portions of tubes 32, further referred to as steam drying portions 32*b*, project upwardly above the surface of the water, within steam chamber 31. Evaporator tank 27 is further provided with a steam outlet 25 in its upper portion, whereby steam generated by evaporator 26 flows out.

First preheating line 15 defines an upstream end 15*a* and a downstream end 15*b* and is connected at its upstream end 15*a* to evaporator heating fluid outlet 30 to retrieve the heating fluid leaving tubes 32 of evaporator 26, which has condensed from gaseous-state water into hot liquid-state water at the end of its circulation along tubes 32. Downstream of its connection to evaporator heating fluid outlet 30, first preheating line 15 comprises a steam trap 34 to prevent passage of gaseous-state water therethrough. Two isolation valves 35, 35 are installed on first preheating line 15 on each side of steam trap 34. Isolation valves 35, 35 are normally opened, but can be manually selectively closed in order to prevent fluid flow to and from steam trap 34, to perform maintenance tasks thereon for example.

The downstream end 16*b* of auxiliary liquid purge line 16 is fluidly connected to first preheating line 15 downstream of steam trap 34. The liquid-state hot water originating from undesirable condensation of the steam injected in heating circuit 12 through upstream end 12*a*, and which travels within auxiliary line 16, merges with the hot liquid water running in first preheating line 15 at this connection point. First preheating line 15, downstream of its connection to auxiliary line 16, is connected to a preheating fluid inlet 42 of a first preheating device 40. Preheating fluid inlet 42 is in fluid communication with a preheating fluid outlet 44 by thermally conductive tubes (concealed within first preheating device 40 in FIG. 1).

The upstream end of an exit line 17 of heating circuit 12 is connected to the preheating fluid outlet 44 of first preheating device 40; the downstream end of exit line 17 coincides with heating circuit downstream end 12*b*. Heating circuit downstream end 12*b* can lead to a thermal station (not shown) to create steam from the liquid-state water flowing out of heating circuit downstream end 12*b* together with a supplementary water source if need be. This steam will then be re-injected in the heating circuit 12 through upstream end 12*a*. It is noted that the heat-transmitting fluid re-circulated repeatedly across heating circuit 12 often contains miscellaneous chemical agents.

Dry steam generator 10 further comprises a second fluid circuit 50 carrying the water transformed into dry steam. Second fluid circuit 50 defines an upstream end 50*a*, to which is connected a water inlet valve 52, and a downstream end 50*b*. Inlet valve 52 can be a solenoid valve for example, and is normally opened but can be automatically selectively closed by a control console 200. Water inlet valve 52 is connected to a clean, uncontaminated cold water supply. Downstream of inlet valve 52, second fluid circuit 50 is connected to a water inlet line 60 which defines upstream and downstream ends 60*a* and 60*b*. A waste line 62 branches off inlet line 60, with a normally closed bypass valve 61 linked to control console 200 preventing the incoming cold water from flowing through waste line 62 to a waste outlet 54 in the normal operation of dry steam generator 10.

A water injection control valve 63 is mounted on water inlet line 60 near its upstream end 60*a*. Control valve 63 is normally closed, but can be selectively opened by control console 200. Downstream of this control valve 63, water inlet line 60 is connected to a water inlet port 46 of first preheating device 40. The relatively cold water streaming within water inlet line 60 can fill preheating device 40 to be preheated therein as heat is transferred thereto from the liquid-state hot water flowing along the thermally conductive tubes of first preheating device 40. First preheating device 40 further comprises a warm water outlet 48, through which the preheated water can be released and re-injected into water inlet line 60.

Downstream of first preheating device 40, water inlet line 60 extends through a second preheating device 70 defining a water inlet 72 and a water outlet 74.

Downstream of the second preheating device 70, water inlet line 60, at its downstream end 60*b*, is connected to the water inlet 82 of a preheating tank 80 having an inner chamber. It is to be noted that water inlet 82 is located upwardly and spacedly from the bottom extremity of preheating tank 80 for reasons detailed hereinafter. Preheating tank 80 is partly filled with water, and defines a precipitation chamber 81 in its inner chamber above the volume of water destined to partly fill preheating tank 80; the volume of precipitation chamber 81 is inversely proportional to the variable percentage of preheating tank 80 filled with liquid-state water. Preheating tank 80 has an inner chamber defining a cross-sectional area $A_2$.

In the vicinity of its top end portion, preheating tank 80 comprises a steam inlet 86 fluidly linked to evaporator steam outlet 25 by a steam pipe 92. Steam pipe 92 defines a cross-sectional area $A_3$, smaller than the cross-sectional area $A_2$ of preheating tank 80.

Preheating tank 80 further comprises a water outlet 84 connected by a water pipe 90 to evaporator water inlet 29, forming a free, opened, continuous liquid communication channel between tanks 27, 80. Accordingly, water injected in preheating tank 80 through water inlet 82 can continuously flow towards evaporator tank 27 through water pipe 90 in order to be distributed and to remain substantially at a same level in tanks 27, 80. Moreover, the fluid link established between evaporator 26 and preheating tank 27 by water pipe 90 allows for the heat emitted by heat-transmitting tubes 32 in the liquid-state water partly filling evaporator tank 27, to also affect and heat up the water partly filling preheating tank 80. Thus, when tubes 32 transfer heat to the water, a temperature gradient is generated in the volume of liquid-state water filling the evaporator tank 27/water pipe 90/preheating tank 80 system, from very hot liquid water in evaporator tank 27 towards gradually cooler, albeit still warm, water near water inlet 82 in preheating tank 80.

It is to be noted that water pipe 90 is downwardly curved, and defines a lower inflexion point 90*a* (FIG. 2), which is lower than the bottom levels 27*a*, 80*a* of evaporator and preheating tanks 27, 80 respectively. A second preheating line 91 stems from pipe 90 at inflexion point 90*a*, which comprises a drain control valve 93 normally closed but which can be selectively opened by control console 200. Under the influence of gravity, macroparticulate debris present in tanks 27 and 80 partly filled with water will be drawn towards this inflexion point 90*a* and will flow into and accumulate in second preheating line 91, upstream of drain control valve 93.

Second preheating fluid line 91 is connected to a preheating fluid inlet 75 of second preheating device 70, and a preheating fluid outlet 77 of second preheating device 70 is connected to waste line 62. Accordingly, if drain control valve 93 is opened, hot water from evaporator tank 27 and preheating tank 80 is drained through second preheating line 91, carrying along any debris, into thermally conductive tubes (not shown) of second preheating device 70, in order to preheat the water located therein, and is finally dispatched in waste line 62. Thus, water circulating in water inlet line 60 is preheated not only through first preheating device 40, but also through second preheating device 70.

A dry steam exhaust port 88 is provided on preheating tank 80 vertically spacedly well above water inlet 82, and is connected to a dry steam exhaust line 94. A manometer 98 is provided on dry steam exhaust line 94, that is linked to steam inlet control valve controller 23 of steam line 14 through the instrumentality of a control link 99. A dry steam outlet control valve 96 is further provided on dry steam exhaust line 94, to regulate the flow rate of dry steam traveling therethrough by means of an outlet controller 97.

A number of sensors, all operatively connected to control console 200, monitor the water level in preheating tank 80. These sensors include upper and lower control sensors 102*a*, 102*b* respectively, and upper and lower security sensors 100*a*, 100*b* respectively. During operation of dry steam generator 10, the water level within preheating tank 80 will be set to remain between upper and lower control sensors 102*a* and 102*b*. Indeed, if the water level drops below lower control sensor 102*b*, the latter will send a signal to control console 200 that will in turn send a signal to open water inlet control valve 63 to feed water into tank 80. When the water level reaches upper control sensor 102*a*, control console 200 will then issue a signal to close water inlet control valve 63. However, in the event of a malfunction of dry steam generator 10, the water level within preheating tank 80 can exceed the level of upper control sensor 102*a* or drop below the level of lower control sensor 102*b*. If the water level within preheating tank 80 lines up with either one of security sensors 100*a* or 100*b*, control console 200 interrupts the operation of dry steam generator 10.

The transformation of liquid water to dry steam will now be detailed.

The heat-transmitting fluid, i.e. the hot steam, continuously circulates within thermally conductive tubes 32 of evaporator 26, and the submerged portions 32*a* of tubes 32 transfer heat to the liquid-state water partly filling evaporator tank 27 to vaporize it. The steam generated by this evaporation is wet, in that it contains not only gaseous water, but also a non-negligible proportion of minute water droplets carried over with and held in suspension in the gaseous water.

This wet steam, once generated, occupies steam chamber 31 and thus comes in contact with the exposed, steam drying portions 32*b* of heat-emitting tubes 32, which form first drying means. The volume of wet steam generated and filling steam chamber 31 is further heated up by steam drying portions 32*b* of tubes 32, thereby vaporizing a certain proportion of the minute water droplets held in suspension in the wet steam, thus drying up the generated wet steam and transforming it into so-called dry steam. In most operation conditions of dry steam generator 10, where the steam demand is substantially constant, most if not almost all of the liquid state water droplets carried by the steam will be vaporized by the steam drying portions 32*b* of tubes 32 to create dry steam. As more water continuously evaporates thereafter, the generated dry steam generally is forced out of steam chamber 31 through steam outlet 25, and migrates towards precipitation chamber 81 of preheating tank 80 in steam pipe 92.

It can happen that the wet steam is not properly dried up by being ridded of a significant proportion of water droplets by mere exposition to the heat-transmitting steam drying portion 32*b* of tubes 32, and is consequently still substantially wet when leaving evaporator unit 26. This situation is especially likely to occur when the dry steam demand at dry steam outlet 50*b* increases suddenly, in which case the pressure decreases downstream of vapor outlet 25 which forms a partial vacuum drawing additional liquid-state water through vapor outlet 25. In such a case, the wet steam generated in evaporator unit 26 leaves steam chamber 31 too rapidly and is not exposed to the heated tubes steam drying portions 32*b* long enough for its suspended water droplets to evaporate.

For this reason, second drying means are provided on dry steam generator 10 to prevent wet steam to be exhausted out of dry steam exhaust port 88 even, especially when the steam demand increases suddenly. Indeed, wet steam outflowing of evaporator 26 is transformed into dry steam by circulating through a passageway 300 having a variable cross-sectional area, illustrated schematically in dotted lines in FIG. 2, and composed of a narrow first portion 300*a* and of a relatively wider second portion 300*b*. First passageway portion 300*a* extends within steam pipe 92 between both ends thereof, i.e. from steam outlet 25 of evaporator tank 27 to steam inlet 86 of preheating tank 80, and second passageway portion 300*b* extends within precipitation chamber 81 of preheating tank 80 between steam inlet 86 and dry steam exhaust port 88. Once the wet steam leaves evaporator steam chamber 31 and penetrates in steam pipe 92, i.e. the first portion 300*a* of passageway 300, the wet steam naturally accelerates since steam pipe 92 has a substantially smaller cross-sectional area ($A_3$) than steam chamber 31 ($A_1$). Then, at the preheating tank steam inlet 86, the wet steam passes from the relatively narrow steam pipe 92, i.e. first passageway portion 300*a* having a cross-sectional area $A_3$, to the wider precipitation chamber 81, i.e. second passageway portion 300*b* having a cross-sectional area $A_2$ broader than the cross-sectional area $A_3$ of first passageway portion 300*a*. As a result of the sudden widening of the cross-sectional area of passageway 300, the flow of wet steam traveling along passageway 300 decelerates to such an extent that most of the water droplets carried by the wet steam precipitate into the volume of water filling preheating tank 80. The steam, once it passes from steam pipe 92 to precipitation chamber 80, is thereby ridded of a significant proportion, if not all of the liquid-state water droplets it carries, if any. Therefore, the remaining steam, i.e. gaseous water and a negligible quantity of water droplets, forming the so-called dry steam, can be exhausted into dry steam exhaust line 94 through dry steam exhaust port 88.

It is to be noted that the liquid-state water filling preheating tank 80, conveyed thereto through water inlet line 60, is further preheated in preheating tank 80 before reaching evaporator tank 27. As described hereinabove, preheating tank 80 is in fluid communication with evaporator tank 27 through water pipe 90, and a temperature gradient is generated by heat-transmitting tubes 32 across the volume of liquid-state water filling the evaporator tank 27/water pipe 90/preheating tank 80 system. Thus, tubes 32 indirectly heat up the liquid-state water in preheating tank 80 which is thereby preheated therein, i.e. brought closer to its boiling point. As water evaporates in evaporator tank 27, the preheated water in preheating tank 80 circulates towards and flows into evaporator tank 27, and since this inflow of water has been thoroughly preheated inter alia in preheating tank 80, and thus brought very close to its boiling point, less supplementary heating energy is required to evaporate it when it reaches evaporator unit 26.

It is however noted that even though the water is brought very close to its boiling point in precipitation tank 80, the purpose is not to preheat the water in preheating tank 80 to the extent of reaching its boiling point and being vaporized in precipitation tank 80. The vaporization of the liquid-state water occurs when the liquid-state water reaches evaporator 26.

It is also noted that the water inlet 82 is located spacedly above the bottom end of preheating tank 80 and is thus significantly spaced from its water outlet 84. Since the water is injected in preheating tank 80 through water inlet 82, significantly spacedly away from water outlet 84, the amount of time freshly injected water remains in preheating tank 80 before reaching water outlet 84 is increased, and so is the amount of time it is preheated therein before flowing into water pipe 90 and towards evaporator unit 26.

As dry steam is generated and exhausted in dry steam exhaust line 94, the amount of liquid water filling evaporator and preheating tanks 27, 80 will progressively decrease. When the water level lines up with lower control sensor 102*b*, control console 200 will react by initiating a refilling routine, to allow water to be reinjected in both tanks 27 and 80. Control console 200 will command the various control valves of the dry steam generator 10 to accomplish this refilling routine, which comprises the following actions:

- opening water injection control valve 63 to inject water in water inlet line 60 at a certain determined flow rate. This causes the water to flow through first and second preheating devices 40, 70 and the pipes of water inlet line 60, to be forced towards water inlet line downstream end 60*b* and towards preheating tank 80. Control console 200 sets control valve 63 back in its closed position when the water level within preheating tank 80 lines up with upper control sensor 102*a*; and
- opening debris drain control valve 93, in synchronism with the opening of water injection control valve 63. As mentioned hereinabove, this allows for hot water from evaporator tank 80, and preheating tank 27 to stream through second preheating line 91 while carrying away the debris accumulated therein upstream of the control valve 93, through the thermally conductive tubes of second preheating device 70, and into the waste line 62. The debris drain control valve 93 (controlling escape of water from the preheating tank 80/evaporator tank 27 system) is opened such that the flow rate therethrough is inferior to the flow rate through water injection control valve 63 (controlling the injection of water into the preheating tank 80/evaporator tank 27 system). Accordingly, the amount of water entering this preheating tank 80/evaporator tank 27 system is greater than the amount of water leaving it, thus allowing for it to fill up.

It is understood that the dry steam demand may vary. When the dry steam demand increases at outlet 50*b*, the yield of dry steam generated by system 10 can be suitably amplified to adequately respond to such an increased demand. Indeed, in the occurrence of an increase in the dry steam demand the pressure within dry steam exhaust line 94 drops. As manometer 98 senses this pressure drop, control valve 22 (which constitutes evaporation rate control means for evaporator unit 26) is controlled to increase the flow rate of steam through steam line 14 and therefore increase the steam flow rate through thermally conductive tubes 32. This causes a higher amount of wet steam per unit of time to be generated in evaporator 26, and thus a higher amount of dry steam to be exhausted through dry steam exhaust line 94.

Occasionally, the dry steam demand can increase very significantly in dry steam generator 10. In such an event, in addition to boosting the evaporation rate in evaporator 26, the flow rate through exit control valve assembly 96 can be momentarily lowered or stopped to allow dry steam to accumulate in precipitation chamber 81 and pressure therein to be increased. When the pressure within precipitation chamber 81 is increased to a suitable level, exit control valve 96 can be re-opened to start adequately supplying dry steam.

Use of dry steam such as that generated by the system of the present invention, obviates a multitude of drawbacks engendered by the use of wet steam. Indeed, the use of dry steam reduces undesirable water precipitation downstream of outlet 50*b*.

Moreover, dry steam generator 10 is very energy efficient. Indeed, a number of preheating steps are accomplished on the water to be evaporated before it is fed to the evaporator. The first preheating step is accomplished in first preheating device 40 using used heating fluid. Even is though the heating fluid transfers an important amount of its heat to the water contained in the evaporator when passing across the thermally conductive tubes, the heating fluid remains very hot and is used by preheating device 40 to preheat the cold water to be evaporated coming from the municipal water main for example. Moreover, when control valve 93 is opened, instead of directly evacuating the debris-carrying water drained through second preheating line 91, this water (which has a relatively high temperature) runs through the thermally conductive tubes of second preheating device 70 to further preheat the clean water to be evaporated before it is introduced in preheating tank 80. Finally, as mentioned hereinabove, right after water is injected in preheating tank 80, it is further gradually preheated as it flows through preheating tank 80 towards evaporator tank 27, where the water is brought very close to its boiling point before reaching evaporator tubes 32, reducing problems related to high temperature differentials in close proximity to the heating tubes 32.

Figure 3:
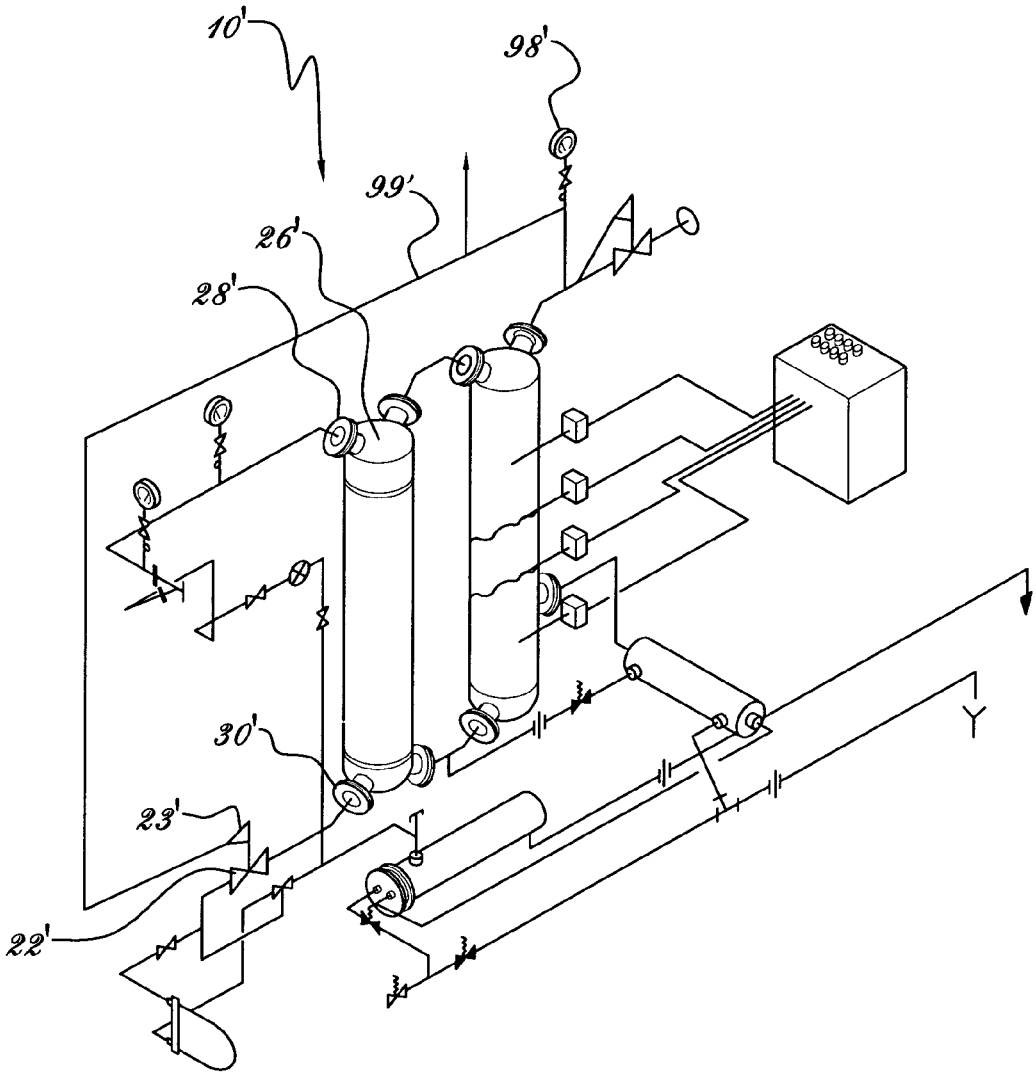
FIG. 3 shows a perspective schematic view of a dry steam generator according to another embodiment of the present invention, where the evaporator unit is a flooded heat exchanger.

FIG. 3 shows a dry steam generator 10' according to an alternate embodiment of the present invention, which is similar to the first embodiment of the dry steam generator 10 shown in FIGS. 1–2 except for the fact that the evaporator unit 26' is a flooded heat exchanger. The flow of heating fluid, e.g. steam, through the heat-transmitting tubes (not shown in FIG. 3) is controlled by means of a steam control valve 22' located downstream of evaporator unit heating fluid outlet 30', instead of being located upstream the evaporator unit heating fluid inlet 28' as in the embodiment of the invention shown in FIGS. 1–2. This flooded heat-exchanger evaporator 26' is designed for allowing the heating fluid, initially in a gaseous state at heating fluid inlet 28' to condense inside its heat-transmitting tubes. A condensed heating fluid column is thus formed in the heat transmitting tubes. Since the passing of a fluid from a gaseous state to a liquid state is highly exothermic, the heat exchange capacity, and therefore the efficiency, of flooded heat exchanger evaporator unit 26' is increased compared to non-flooded heat exchanger units.

The "flooding" of the heat exchanger derives from this change into a liquid state of the heating fluid within the heat transmitting tubes that remain partly filled with liquid-state water. The percentage of the pipes that will be flooded, i.e. that will be filled with liquid-state heating fluid, will depend on the configuration of the heat exchanger, and of the position of the control valve 22' placed downstream of the heat transmitting tubes. Indeed, by controlling control valve 22' (which is controlled by a control valve controller 23' linked to a manometer 98' through the instrumentality of a control link 99') towards a closed condition, the percentage of liquid water in the tubes—i.e. the height of the condensed heating fluid column—increases and the percentage of steam therein decreases, thereby decreasing the heat-exchange rate of evaporator 26'. By controlling control valve 22' towards a opened condition, the percentage of liquid water in the tubes decreases and the percentage of steam therein increases, thereby increasing the heat-exchange rate of the evaporator 26'.

The embodiments of the present invention, in which an exclusive property or privilege is claimed, are defined as follows:

1. A vapor generator, comprising:

an evaporator unit comprising an inner chamber for containing a first fluid in a liquid state, and further comprising a preheated liquid inlet, and a vapor outlet, said evaporator unit having a heating device therein which can be activated for vaporizing the first fluid contained in said inner chamber to generate vapor;

a preheating tank defining an inner chamber and comprising a liquid inlet for injection of the first fluid in a liquid state in said inner chamber, and a liquid outlet; and an opened liquid channel connecting said preheating tank liquid outlet to said evaporator unit liquid inlet, and establishing free and continuous fluid communication between said preheating tank inner chamber and said evaporator unit inner chamber;

wherein the first fluid in a liquid state injected through said preheating tank liquid inlet is continuously distributed between said evaporator unit inner chamber and said preheating tank inner chamber through said liquid channel, and wherein said heating device of said evaporator unit can be activated for generating a temperature gradient across the liquid-state first fluid contained in said evaporator unit inner chamber, said liquid channel and said preheating tank inner chamber, the first fluid being thereby gradually preheated while it circulates from said preheating tank through said liquid channel and into said evaporator unit for being vaporized therein.

2. The vapor generator according to claim 1, wherein said liquid inlet and said liquid outlet of said preheating tank are significantly spaced apart from each other for allowing the liquid-state first fluid injected in said preheating tank to be preheated in said preheating tank before reaching said preheating tank liquid outlet.

3. The vapor generator according to claim 1, wherein said preheating tank further defines a vapor inlet and a dry vapor exhaust port, said vapor generator further comprising:

a vapor channel linking said evaporator unit vapor outlet to said preheating tank vapor inlet;

a passageway extending between said evaporator unit vapor outlet and said preheating tank dry vapor exhaust port, said passageway defining a first portion extending within said vapor channel and a second portion wider than said first portion extending within said preheating tank;

wherein vapor generated from said first fluid in said evaporator unit and flowing out of said evaporator unit vapor outlet and along said passageway towards said dry vapor exhaust port will lose velocity when the vapor passes from said first passageway portion to said relatively wider second passageway portion to the extent of causing liquid-state first fluid droplets carried by the vapor to precipitate in said preheating tank for creating dry vapor to be exhausted through said dry vapor exhaust port.

4. The vapor generator according to claim 3, wherein said preheating tank inner chamber defines a first cross-sectional area, and said vapor channel defines a second cross-sectional area smaller than said first cross-sectional area.

5. The vapor generator according to claim 1, wherein said heating device comprises at least one thermally conductive tube extending in said evaporator unit inner chamber and for allowing a substantially hot heating fluid to flow therein for transferring heat to the first fluid in said inner chamber.

6. The vapor generator according to claim 1, wherein a vapor chamber is defined in said evaporator unit inner chamber above the level of the liquid-state first fluid filling it, said evaporator unit comprising heat-emitting vapor drying means in said vapor chamber, wherein wet vapor occupying said vapor chamber after it is generated in said evaporator unit is dried therein by said heat-emitting vapor drying means.

7. The vapor generator according to claim 6, wherein said evaporator unit comprises evaporation rate control means for controlling the generation rate of vapor in said evaporator unit, thereby controlling the generation rate of dry vapor in said dry vapor generator.

8. The vapor generator according to claim 7, wherein said heating device includes at least one thermally conductive tube extending in said evaporator unit inner chamber and for allowing a substantially hot heating fluid to flow therein for transferring heat to the liquid-state first fluid in said inner chamber, an upper portion of said at least one thermally conductive tube extending in said vapor chamber above the level of the liquid-state first fluid contained in said evaporator unit, said upper portion of said tube forming said vapor drying means.

9. The vapor generator according to claim 8, wherein said at least one heat-transmitting tube defines upstream and downstream ends, and is connected at said upstream and downstream ends to a heating fluid circuit in which the heating fluid is destined to circulate.

10. The vapor generator according to claim 9, wherein said evaporation rate control means comprise a control valve installed on said heating circuit upstream said at least one heat-transmitting tube.

11. The vapor generator according to claim 9, wherein said evaporator unit includes a flooded heat exchanger, and wherein said evaporation rate control means comprise a control valve installed on said heating circuit downstream said at least one heat-transmitting tube.

12. The vapor generator according to claim 1, wherein said liquid inlet of said preheating tank is connected to a first fluid inlet line, which is provided with at least one preheating device for preheating the first fluid in a liquid state before it is injected in said preheating tank.

13. The vapor generator according to claim 12, wherein said preheating device includes a liquid-state first fluid drainage port for allowing said evaporator unit and said preheating tank to be drained of liquid-state first fluid, said drainage port being linked to a liquid-state first fluid drainage line extending through a first heat exchanger through which said first fluid inlet line also extends for allowing drained first fluid to preheat the first fluid being fed to said preheating tank.

14. The vapor generator according to claim 13, wherein said preheating device further comprises a second heat exchanger through which said first fluid inlet line extends for further preheating the liquid-state first fluid being fed into said preheating tank.

15. The vapor generator according to claim 14, further comprising a heating circuit through which a heating fluid circulates, said heating circuit being fluidly connected to at least one heat-transmitting tube extending through said evaporator unit inner chamber for allowing the heating fluid to flow therethrough for heating the liquid-state first fluid contained in said evaporator unit inner chamber, and wherein said second heat exchanger is connected to said heating circuit downstream of said heat-transmitting tube for allowing the heating fluid exiting said heat-transmitting tube of said evaporator unit to also preheat the first fluid being fed to said preheating tank.

16. A vapor generator for generating vapor by heating a second fluid with a first fluid, comprising:

a first fluid circuit comprising an upstream end, a downstream end and an intermediate portion therebetween, for allowing the first fluid to flow from said first fluid circuit upstream end to said first fluid circuit downstream end;

a second fluid circuit comprising an upstream end, a downstream end and an intermediate portion therebetween for allowing the second fluid to flow from said second fluid circuit upstream end to said second fluid circuit downstream end;

a heat exchanger unit wherein said intermediate portions of said first and second fluid circuits extend and are in adjacent, thermally-conductive contact for allowing heat transfer from the first fluid to the second fluid whereby liquid state second fluid can be evaporated into gazeous state, said heat exchanger unit comprising on said second fluid circuit a liquid-state second fluid inlet for allowing liquid-state second fluid to flow through said second fluid circuit intermdiate portion, and a gazeous-state second fluid outlet downstream of said liquid-state second fluid inlet for allowing gazeous-state second fluid to exit said heat exchanger unit;

a control valve on said first fluid circuit for controlling the flow rate of the first fluid in said first fluid circuit;

a preheating tank part of said second fluid circuit and upstream of said heat exchanger unit, said preheating tank comprising an inner chamber having a liquid-state second fluid inlet for injecting liquid-state second fluid in said preheating tank inner chamber, and a liquid-state second fluid outlet downstream of said liquid-state second fluid inlet for allowing liquid-state second fluid to exit said preheating tank inner chamber; and an opened liquid channel linking said preheating tank liquid-state second fluid outlet and said heat exchanger unit liquid-state second fluid inlet, and establishing free and continuous fluid communication between said heat exchanger unit and said preheating tank for allowing the liquid-state second fluid to be freely distributed between said preheating tank inner chamber and said heat exchanger unit;

wherein liquid-state second fluid injected through said preheating tank liquid-state second fluid inlet is gradually preheated as it flows through said preheating tank, said liquid channel and said heat exchanger unit second fluid circuit intermediate portion before being evaporated in said heat exchanger unit by means of the heat transfer from said first fluid circuit intermediate portion.

17. A vapor generator as defined in claim 16, wherein said preheating tank further comprises a gazeous-state second fluid outlet and a gazeous-state second fluid inlet connected to said heat exchanger gazeous-state second fluid outlet with a vapor channel, said preheating tank inner chamber defining a vapor chamber portion between said gazeous-state second fluid inlet and said gazeous-state second fluid outlet, with said preheating tank vapor chamber portion being wider than said vapor channel for allowing gazeous-state second fluid flowing from said vapor channel into said preheating tank vapor chamber to lose velocity for allowing liquid-state second fluid droplets carried by the gazeous-state second fluid to precipitate in said preheating tank for creating dry vapor that will be exhausted through said preheating tank gazeous-state second fluid outlet.

18. A vapor generator as defined in claim 17, wherein said heat exchanger unit is a flooded heat exchanger with said second fluid circuit intermediate portion comprising a heat exchanger inner chamber and said first fluid circuit intermediate portion comprising a number of heat-conducting tubes extending through said heat exchanger inner chamber for allowing said first fluid to flow through said tubes and the second fluid to be contained in said inner chamber, with said tubes being capable of being flooded with liquid-state first fluid in a determined proportion, said control valve being located downstream of said heat exchanger unit on said first fluid circuit whereby the proportion of said heat exchanger which is flooded within said second fluid circuit intermediate portion can be selectively calibrated.

19. A vapor generator as defined in claim 18, further comprising a liquid level controller for controlling the level of liquid-state second fluid in said preheating tank and in said heat exchanger unit inner chamber to maintain the level of liquid-state second fluid within top and bottom determined threshold values, whereby said preheating tank vapor chamber portion is defined above a variable liquid-state second fluid value which will not exceed said top threshold value, and whereby said heat exchanger unit inner chamber also defines a vapor chamber portion above a variable liquid-state second fluid value which will not exceed said top threshold value, with said tubes extending in said heat exchanger unit inner chamber at least partly above said top threshold value for allowing liquid-state second fluid carried by gazeous-state second fluid as it is evaporated in said heat exchanger unit inner chamber to be heated and evaporated through heat transfer from said tubes for creating dry vapor.

* * * * *